US008159436B2

(12) United States Patent
Tu et al.

(10) Patent No.: US 8,159,436 B2
(45) Date of Patent: Apr. 17, 2012

(54) DATA DRIVER USING A GAMMA SELECTING SIGNAL, A FLAT PANEL DISPLAY WITH THE SAME AND A DRIVING METHOD THEREFOR

(75) Inventors: Ming-Hung Tu, Hsin-Chu (TW); Chih-Hsiang Yang, Hsin-Chu (TW)

(73) Assignee: Au Optronics Corp., Hsin-Chu (TW)

( * ) Notice: Subject to any disclaimer, the term of this patent is extended or adjusted under 35 U.S.C. 154(b) by 859 days.

(21) Appl. No.: 12/081,425

(22) Filed: Apr. 16, 2008

(65) Prior Publication Data

US 2009/0160879 A1 Jun. 25, 2009

(30) Foreign Application Priority Data

Dec. 20, 2007 (TW) ..... 96148927 A

(51) Int. Cl.
*G09G 5/00* (2006.01)
*G09G 3/36* (2006.01)

(52) U.S. Cl. ..... 345/89; 345/690

(58) Field of Classification Search ..... 345/76, 345/87, 89, 94, 98, 100, 204, 690, 50, 51, 345/54, 55, 90, 96, 208, 209, 211, 214, 240, 345/694, 695, 792, 793, 63; 349/106, 144
See application file for complete search history.

(56) References Cited

U.S. PATENT DOCUMENTS 5,606,437 A * 2/1997 Mosier ..... 349/106
6,067,063 A * 5/2000 Kim et al. ..... 345/89
6,894,670 B2 * 5/2005 Funakoshi et al. ..... 345/89
7,567,092 B2 * 7/2009 Park et al. ..... 324/760.01
7,683,872 B2 * 3/2010 Jan et al. ..... 345/96
7,728,854 B2 * 6/2010 Kim et al. ..... 345/690
2005/0276088 A1 * 12/2005 Moon et al. ..... 365/63
2006/0071924 A1 * 4/2006 Svensson et al. ..... 345/204
2006/0132408 A1 * 6/2006 Shin et al. ..... 345/89
2006/0231838 A1 * 10/2006 Kim ..... 257/59

FOREIGN PATENT DOCUMENTS

KR 10-2005-006839 * 9/2007
KR 10-2005-0006839 * 9/2007
KR 10-20050006839 * 9/2007

OTHER PUBLICATIONS

Johns et al., Analog Integrated Circuit Design, 1997, John Wiley and Sons Inc., 1st Ed., 445, 447, 463.*

* cited by examiner

*Primary Examiner* — Quan-Zhen Wang
*Assistant Examiner* — Michael J Eurice
(74) *Attorney, Agent, or Firm* — Bacon & Thomas, PLLC

(57) ABSTRACT

A data driver using a gamma selecting signal, a flat panel display with the same and a driving method therefor are provided. A first to a fourth data lines are electrically connected to a first left sub-pixel, a first right sub-pixel, a second right sub-pixel and a second left sub-pixel, respectively. The data driver includes a first, a second, a third and a fourth gray level generating units for outputting a first set of positive gray voltage, a second set of negative gray voltage, a second set of positive gray voltage and a first set of negative gray voltage, respectively. The data driver drivers these sub-pixels according to the first set of positive gray voltage, the second set of negative gray voltage, the second set of positive gray voltage and the first set of negative gray voltage under the control of a polarity inversion signal and a gamma selecting signal.

16 Claims, 12 Drawing Sheets

106

DATA DRIVER USING A GAMMA SELECTING SIGNAL, A FLAT PANEL DISPLAY WITH THE SAME AND A DRIVING METHOD THEREFOR

This application claims the benefit of Taiwan application Serial No. 96148927, filed Dec. 20, 2007, the subject matter of which is incorporated herein by reference.

BACKGROUND OF THE INVENTION

1. Field of the Invention

The invention relates in general to a data driver and a flat panel with the same and a driving method therefor and more particularly to a data driver using a gamma selecting signal and a flat panel with the same and a driving method therefor.

2. Description of the Related Art

Due to the advantages of slimness, compactness, low weight, low radiation and small volume, flat panel display has gradually become a mainstream product in display market. However, how to increase view angle is still crucial to the display quality of a flat panel display.

Let liquid crystal display be taken for example. The conventional driving method increases the view angle of a liquid crystal display by allowing a pixel to receive two different pixel voltages within a frame time so that liquid crystal molecules are arranged in different directions. According to a method of achieving the above effect, two data items corresponding to the same pixel are sequentially transmitted to a data driver by a timing controller within a frame time for enabling the data driver to generate two different pixel voltages corresponding to the pixel so as to increase the view angle of the liquid crystal display.

However, compared with another method of transmitting a data item corresponding to a pixel to a liquid crystal display using a data driver by a timing controller within a frame time, the frequency of the clock signal of the timing controller and the data driver used in a liquid crystal display according to the above method of increasing view angle must be doubled so as to transmit or receive the data completely. Thus, the circuit design of the timing controller and the data driver becomes more complicated and costive.

SUMMARY OF THE INVENTION

The invention is directed to a data driver using a gamma selecting signal and a flat panel display with the data driver and a driving method therefor. According to the invention, the view angle is improved without raising the frequencies of the clock signals of a timing controller and a data driver. Meanwhile, the invention has excellent flexibility and is applicable to flat panel display under various driving methods.

According to a first aspect of the present invention, a data driver including a first to a fourth gray voltage generating units, a first to a fourth digital-to-analog converters and a first to a fourth buffers is provided. The first to the fourth gray voltage generating units are for outputting a first set of positive gray voltage, a second set of negative gray voltage, a second set of positive gray voltage and a first set of negative gray voltage, respectively. When a gamma selecting signal is in a first state, the input ends of the first to the fourth digital-to-analog converters are electrically connected to the output ends of the first to the fourth gray voltage generating units, respectively. When the gamma selecting signal is in a second state, the input ends of the first to the fourth digital-to-analog converters are electrically connected to the output ends of the third, the fourth, the first gray voltage and the second gray voltage generating units, respectively. When a polarity inversion signal is in a third state, the input ends of the first to the fourth buffers are electrically connected to the output ends of the first to the fourth digital-to-analog converters, respectively. When the polarity inversion signal is in a fourth state, the input ends of the first to the fourth buffers are electrically connected to the output ends of the second, the first, the fourth and the third digital-to-analog converters, respectively.

According to a second aspect of the present invention, a flat panel display including a flat panel, a timing controller and a data driver is provided. The flat panel includes a first pixel, a second pixel, a first scan line and a first to a fourth data lines. The first pixel includes a first left sub-pixel and a first right sub-pixel. The second pixel includes a second left sub-pixel and a second right sub-pixel. The first scan line is for controlling the first and the second pixels. The first to the fourth data line are electrically connected to the first left sub-pixel, the first right sub-pixel, the second right sub-pixel and the second left sub-pixel, respectively. The timing controller is for outputting a polarity inversion signal and a gamma selecting signal. The data driver includes a first to a fourth gray voltage generating units for outputting a first set of positive gray voltage, a second set of negative gray voltage, a second set of positive gray voltage and a first set of negative gray voltage, respectively. The data driver drives these sub-pixels according to the first set of positive gray voltage, the second set of negative gray voltage, the second set of positive gray voltage and the first set of negative gray voltage under the control of the polarity inversion signal and the gamma selecting signal.

The invention will become apparent from the following detailed description of the preferred but non-limiting embodiments. The following description is made with reference to the accompanying drawings.

DETAILED DESCRIPTION OF THE INVENTION

The data driver of the invention generates several sets of positive gray voltage and negative gray voltage for enabling the sub-pixels of a pixel to receive the pixel voltages generated according to the corresponding set of positive gray voltage and negative gray voltage. Thus, for a pixel, a timing controller can only provide an item of pixel data and the sub-pixels of a pixel can be driven by different pixel voltages, hence effectively increasing the view angle of the pixel. Meanwhile, the invention has excellent flexibility and is applicable to the flat panel display using various driving methods.

First Embodiment

Figure 1:
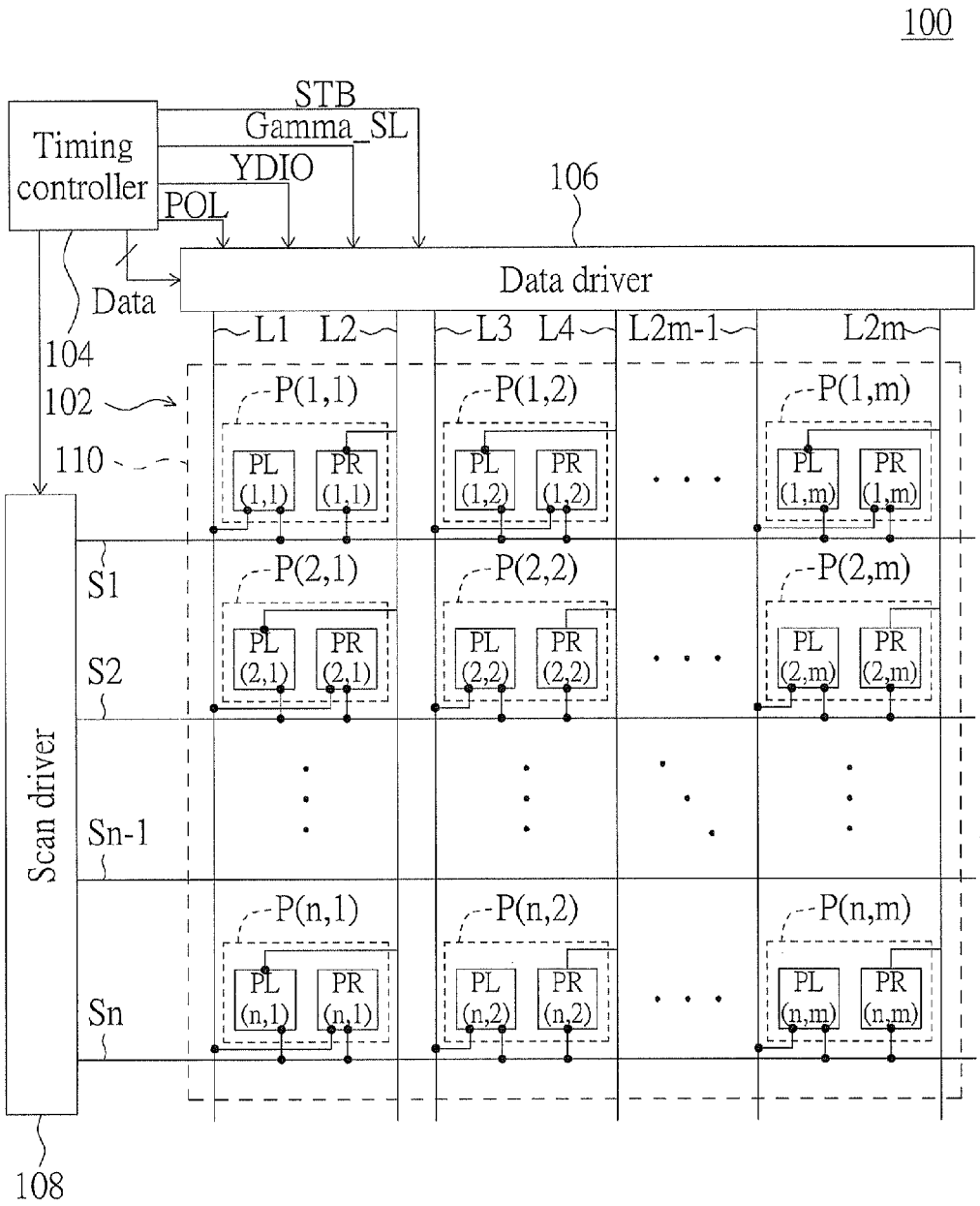
FIG. 1 shows a flat panel display of dot inversion driving method according to a first embodiment of the invention.

Referring to FIG. 1, a flat panel display of dot inversion driving method according to a first embodiment of the invention is shown. The flat panel display 100 includes a flat panel 102, a timing controller 104, a data driver 106 and a scan driver 108. The flat panel 102 includes a pixel array 110 including n rows and m columns of pixels P, a number of scan lines S1~Sn and a number of data lines L1~L2*m*, wherein both n and m are positive integers.

Let a pixel P(1,1) and a pixel P(1,2) be taken for example. The pixel P(1,1) includes a left sub-pixel PL(1,1) and a right sub-pixel PR(1,1). The pixel P(1,2) includes a left sub-pixel PL(1,2) and a right sub-pixel PR(1,2). The scan line S1 is for controlling the pixel P(1,1) and the pixel P(1,2). The data lines L1~L4 are electrically connected to the left sub-pixel PL(1,1), the right sub-pixel PR(1,1), the right sub-pixel PR(1,2) and left sub-pixel PL(1,2), respectively.

The timing controller 104 is for outputting a charge/discharge starting signal STB, a gamma selecting signal Gamma_SL, a frame starting signal YDIO, a polarity inversion signal POL and pixel data Data to the data driver 106. The data driver 106 drives the pixel array 110 via the data lines L1~L2*m*. The scan driver 108 controls the pixel array via the scan lines S1~Sn.

Figure 2:
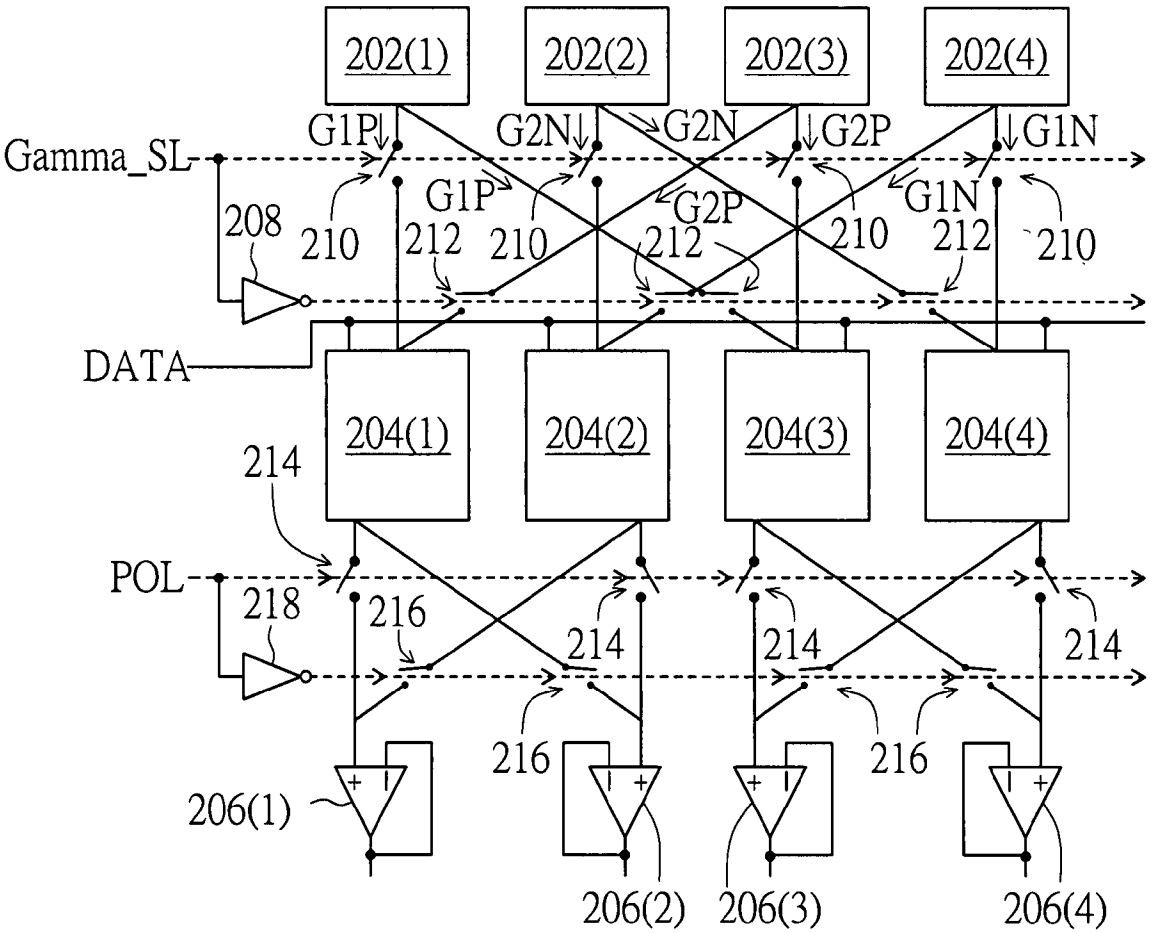
FIG. 2 shows an example of a block diagram of a data driver of FIG. 1.

Referring to FIG. 2, an example of a block diagram of a data driver of FIG. 1 is shown. The data driver 106 includes a first gray voltage generating unit 202(1), a second gray voltage generating unit 202(2), a third gray voltage generating unit 202(3) and a fourth gray voltage generating unit 202(4) for outputting a first set of positive gray voltage G1P, a second set of negative gray voltage G2N, a second set of positive gray voltage G2P and a first set of negative gray voltage G1N, respectively. The first set of positive gray voltage G1P and the first set of negative gray voltage G1N correspond to the left sub-pixels PL(1,1) and PL(1,2), respectively. The second set of positive gray voltage and the second set of negative gray voltage correspond to the right sub-pixels PR(1,1) and PR(1,2), respectively.

The data driver 106 can further includes a first digital-to-analog converter 204(1), a second digital-to-analog converter 204(2), a third digital-to-analog converter 204(3) and a fourth digital-to-analog converter 204(4). When the gamma selecting signal Gamma_SL is in a first state, the input ends of the first to the fourth digital-to-analog converters 204(1)~204(4) are electrically connected to the output ends of the first to the fourth gray voltage generating units 202(1)~202(4), respectively. When the gamma selecting signal Gamma_SL is in a second state, the input ends of the first to the fourth digital-to-analog converters 204(1)~204(4) are electrically connected to the output ends of the third, the fourth, the first and the second gray voltage generating units 202(3), 202(4), 202(1) and 202(2), respectively.

Preferably, in the data driver 106, the gamma selecting signal Gamma_SL selectively controls a number of switches 210 for electrically connecting the input ends of the first to the fourth digital-to-analog converters 204(1)~204(4) to the output ends of the first to the fourth gray voltage generating units 202(1)~202(4), respectively. The gamma selecting signal Gamma_SL processed by the inverter 208 selectively controls a number of switches 212 for electrically connecting the input ends of the first to the fourth digital-to-analog converters 204(1)~204(4) to the output ends of the third, the fourth, the first and the second gray voltage generating units 202(3), 202(4), 202(1) and 202(2), respectively.

The data driver 106 can further include a first to a fourth buffers 206(1)~206(4). When the polarity inversion signal POL is in a third state, the input ends of the first to the fourth buffers 206(1)~206(4) are electrically connected to the output ends of the first to the fourth digital-to-analog converters 204(1)~204(4), respectively. When the polarity inversion signal POL is in a fourth state, the input ends of the first to the fourth buffers 206(1)~206(4) are electrically connected to the output ends of the second, the first, the fourth and the third digital-to-analog converters 204(2), 204(1), 204(4) and 204(3), respectively. The output ends of the first to the fourth buffers 206(1)~206(4) are electrically connected to the first to the fourth data lines L1~L4, respectively.

Preferably, in the data driver 106, the polarity inversion signal POL selectively controls a number of switches 214 for electrically connecting the input ends of the first to the fourth buffers 206(1)~206(4) to the output ends of the first to the fourth digital-to-analog converters 204(1)~204(4), respectively. The polarity inversion signal POL processed by the inverter 218 selectively controls a number of switches 216 for electrically connecting the input ends of the first to the fourth buffers 206(1)~206(4) to the output ends of the second, the first, the fourth and the third digital-to-analog converters 204(2), 204(1), 204(4) and 204(3), respectively.

Figure 3:
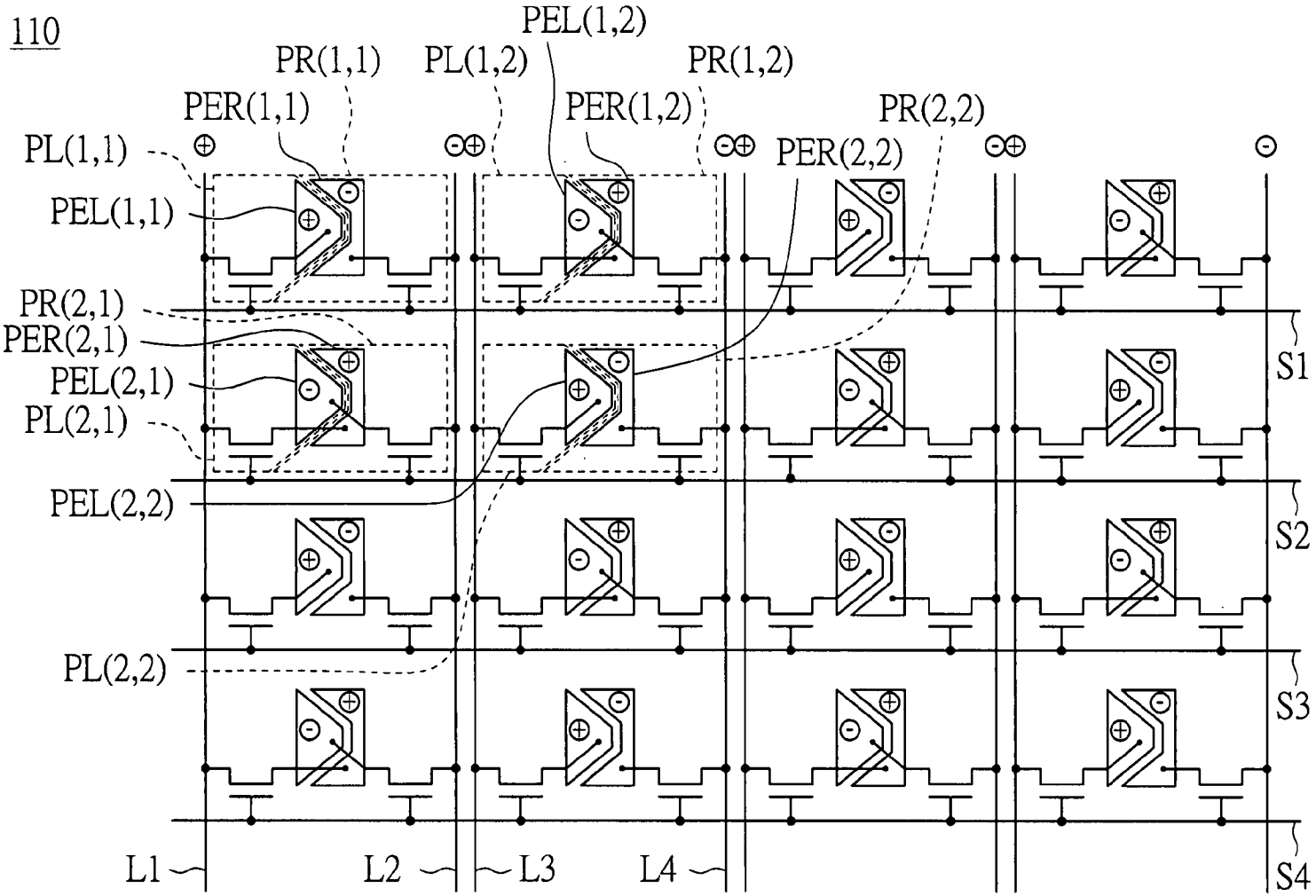
FIG. 3 shows an example of a pixel array of FIG. 1.
Figure 4:
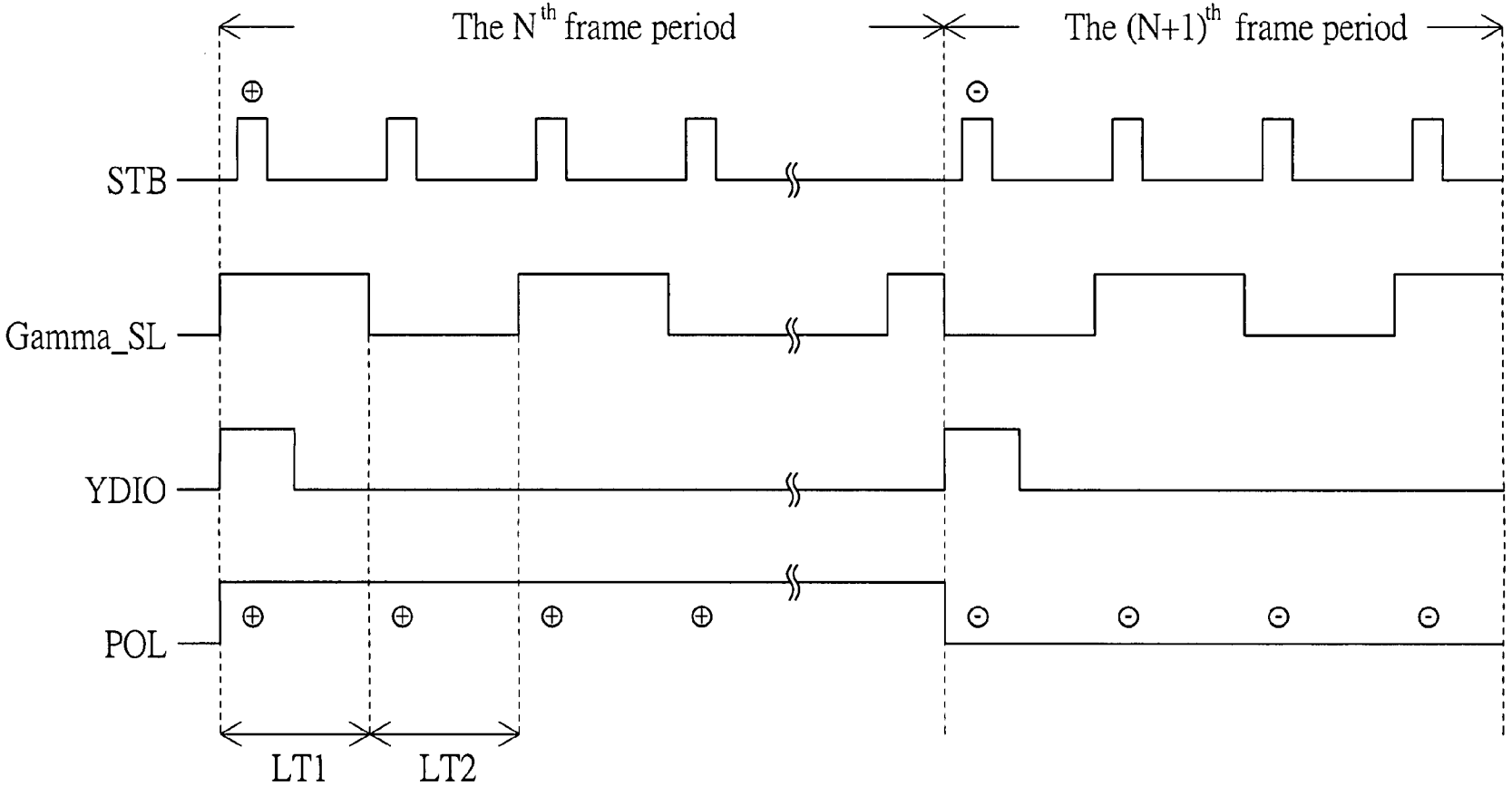
FIG. 4 shows an example of a charge/discharge starting signal STB, a gamma selecting signal Gamma_SL, a frame starting signal YDIO and a polarity inversion signal POL according to an embodiment of the invention.

The operation of the present embodiment of the invention is elaborated below. Referring to FIG. 3, FIG. 4, FIG. 5A and FIG. 5B, FIG. 3 shows an example of a pixel array of FIG. 1; FIG. 4 shows an example of a charge/discharge starting signal STB, a gamma selecting signal Gamma_SL, a frame starting signal YDIO and a polarity inversion signal POL according to the present embodiment of the invention; and FIG. 5A and FIG. 5B respectively show the equivalent circuit diagrams of the data driver of FIG. 2 within a first line period LT1 and a second line period LT2 of an $N^{th}$ frame period of FIG. 4, wherein N is a positive integer.

Figure 5A:
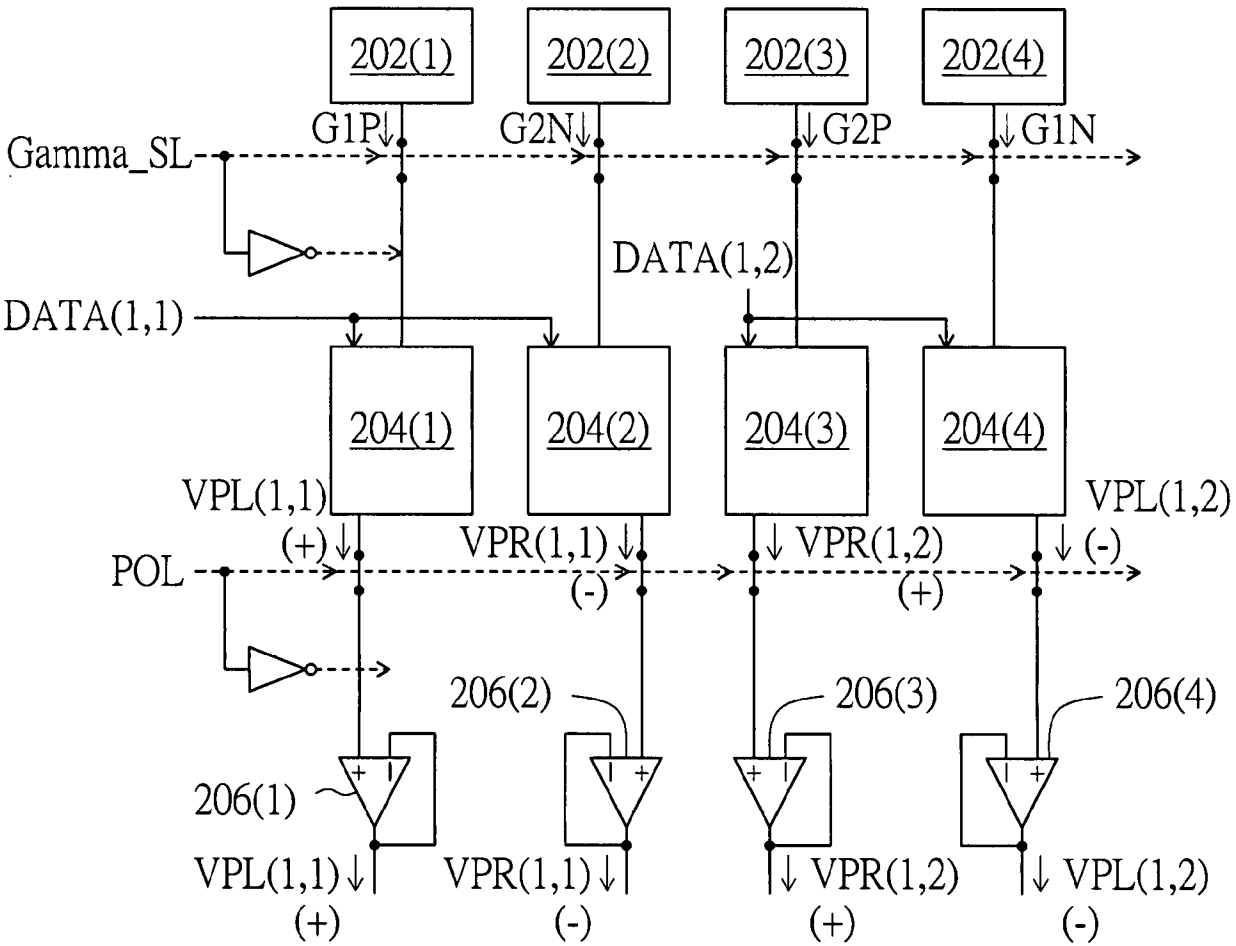
FIG. 5A and FIG. 5B respectively show the equivalent circuit diagrams of the data driver of FIG. 2 within a first line period LT1 and a second line period LT2 of an $N^{th}$ frame period of FIG. 4.

As indicated in FIG. 5A, within the first line period LT1, the data driver 106 drives the pixels disposed in the first row of the pixel array 110. Let the pixels P(1,1) and P(1,2) disposed in the first row be taken for example. The timing controller 106 outputs the pixel data DATA(1,1) corresponding to the pixel P(1,1) to the first and the second digital-to-analog converters 204(1) and 204(2) and outputs the pixel data DATA(1,2) corresponding to the pixel P(1,2) to the third and the fourth digital-to-analog converters 204(3) and 204(4).

Meanwhile, the gamma selecting signal Gamma_SL is in the first state such as at a high level and the polarity inversion signal POL is in the third state such as at a high level. Thus, the first set of positive gray voltage G1P outputted by the first gray voltage generating unit 202(1) is transmitted to the first digital-to-analog converter 204(1) which then converts the pixel data DATA(1,1) into a positive polarity pixel voltage VPL(1,1) according to the first set of positive gray voltage G1P. The second set of negative gray voltage G2N, the second set of positive gray voltage G2P and the first set of negative gray voltage G1N outputted by the second, the third and the fourth gray voltage generating unit 202(2)~202(4) respectively are transmitted to the second, the third and the fourth digital-to-analog converters 204(2)~204(4). The second digital-to-analog converter 204(2) then converts the pixel data DATA(1,1) into a negative polarity pixel voltage VPR(1,1) according to the second set of negative gray voltage G2N. The third digital-to-analog converter 204(3) converts the pixel data DATA(1,2) into a positive polarity pixel voltage VPR(1,2) according to the second set of positive gray voltage G2P. The fourth digital-to-analog converter 204(4) converts the pixel data DATA(1,2) into a negative polarity pixel voltage VPL(1,2) according to the first set of negative gray voltage G1N.

After that, the positive polarity pixel voltage VPL(1,1), the negative polarity pixel voltage VPR(1,1), the positive polarity pixel voltage VPR(1,2) and the negative polarity pixel voltage VPL(1,2) are transmitted to the data lines L1~L4 via the first to the fourth buffers 206(1)~206(4), respectively. The positive polarity pixel voltage VPL(1,1), the negative polarity pixel voltage VPR(1,1), the positive polarity pixel voltage VPR(1,2) and the negative polarity pixel voltage VPL(1,2) are further transmitted to the left sub-pixel PL(1,1), the right sub-pixel PR(1,1), the right sub-pixel PR(1,2) and the left sub-pixel PL(1,2) which are electrically connected to the data lines L1~L4, respectively. The distribution of the polarities of these sub-pixels is indicated in FIG. 3.

Figure 5B:
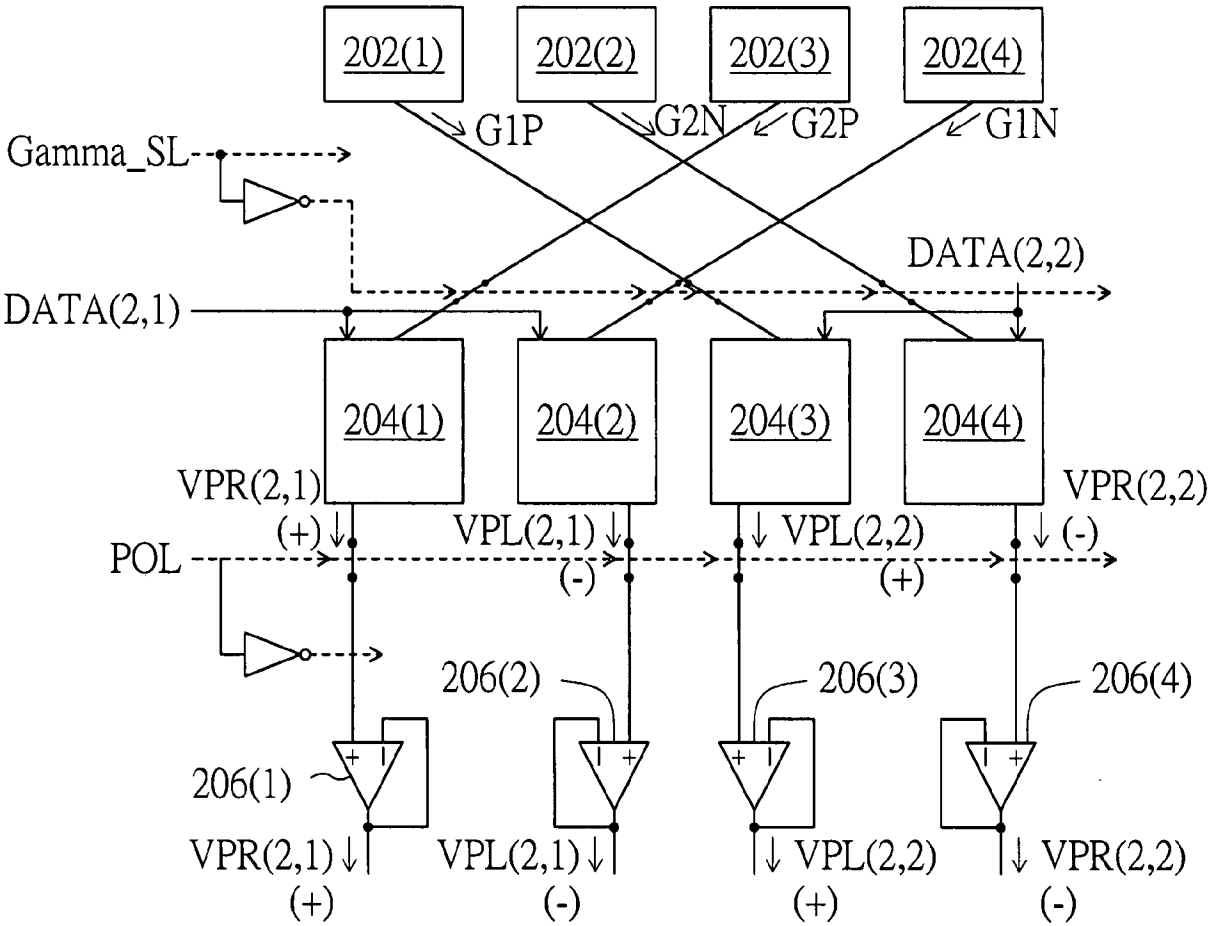

Afterwards, as indicated in FIG. 5B, within the second line period LT2, the data driver 106 drives the pixels disposed in the second row of the pixel array 110. Let the pixels P(2,1) and P(2,2) disposed in the second row be taken for example. The pixel P(2,1) includes a left sub-pixel PL(2,1) and a right sub-pixel PR(2,1). The pixel P(2,2) includes a left sub-pixel PL(2,2) and a right sub-pixel PR(2,2). The first to the fourth data lines L1~L4 are electrically connected to the right sub-pixel PR(2,1), the left sub-pixel PL(2,1), the left sub-pixel PL(2,2) and the right sub-pixel PR(2,2), respectively. The scan line S2 is adjacent to the scan line S1 for controlling the pixels P(2,1) and P(2,2).

Within the second line period LT2, the timing controller 106 outputs the pixel data DATA(2,1) corresponding to the pixel P(2,1) to the first and the second digital-to-analog converters 204(1) and 204(2) and outputs the pixel data DATA (2,2) corresponding to the pixel P(2,2) to the third and the fourth digital-to-analog converters 204(3) and 204(4).

Meanwhile, the gamma selecting signal Gamma_SL is in the second state such as at a low level, and the polarity inversion signal POL is also in the third state (high level). Thus, the first set of positive gray voltage G1P outputted by the first gray voltage generating unit 202(1) is transmitted to the third digital-to-analog converter 204(3), which then converts the pixel data DATA(2,2) into a positive polarity pixel voltage VPL(2,2) according to the first set of positive gray voltage G1P. The second set of negative gray voltage G2N, the second set of positive gray voltage G2P and the first set of negative gray voltage G1N outputted by the second, the third and the fourth gray voltage generating units 202(2)~202(4) are transmitted to the fourth, the first and the second digital-to-analog converters 204(4), 204(1) and 204(2), respectively. The fourth digital-to-analog converter 204(4) converts the pixel data DATA(2,2) into a negative polarity pixel voltage VPR(2,2) according to the second set of negative gray voltage G2N. The first digital-to-analog converter 204(1) converts the pixel data DATA(2,1) into a positive polarity pixel voltage VPR(2,1) according to the second set of positive gray voltage G2P. The second digital-to-analog converter 204(2) converts the pixel data DATA(2,1) into a negative polarity pixel voltage VPL(2,1) according to the first set of negative gray voltage G1N.

Then, the positive polarity pixel voltage VPR(2,1), the negative polarity pixel voltage VPL(2,1), the positive polarity pixel voltage VPL(2,2) and the negative polarity pixel voltage VPR(2,2) are transmitted to the data lines L1~L4 via the first to the fourth buffers 206(1)~206(4), respectively. The positive polarity pixel voltage VPR(2,1), the negative polarity pixel voltage VPL(2,1), the positive polarity pixel voltage VPL(2,2) and the negative polarity pixel voltage VPR(2,2) respectively are further transmitted to the right sub-pixel PR(2,1), the left sub-pixel PL(2,1), the left sub-pixel PL(2,2) and the right sub-pixel PR(2,2) which are electrically connected to the data lines L1~L4. The distribution of the polarities of these sub-pixels is indicated in FIG. 3.

As indicated in FIG. 4, when the pixels P(1,1) and P(1,2) are driven in an $N^{th}$ frame time, the polarity inversion signal POL is in a third state (high level). When the pixels P(1,1) and P(1,2) are driven in an $(N+1)^{th}$ frame time, the polarity inversion signal POL is in a fourth state (low level ). The $N^{th}$ frame time and the $(N+1)^{th}$ frame time are adjacent to each other. Thus, the polarities of two adjacent frames are inverted.

As indicated in FIG. 3, the polarity of the left sub-pixel PL(1,1) is opposite to that of the left sub-pixel PL(1,2), and so is the polarity of the left sub-pixel PL(1,1) opposite to that of the left sub-pixel PL(2,1). In the next frame time, the polarities of all sub-pixels are opposite to the polarities of the sub-pixels corresponding to the previous frame time. Thus, the driving method according to the waveform of FIG. 4 achieves dot inversion driving.

Despite the polarity of the sub-pixels disposed in the same row is opposite to the polarity of the sub-pixels disposed in the adjacent row, the pixel voltages transmitted on the same data line have the same polarity. For example, the data line L1 transmits the pixel voltage VPL(1,1) with positive polarity within the first line period LT1, and transmits the pixel voltage VPR(2,1) with positive polarity within the second line period LT2. As the pixel voltages transmitted on the same data line have the same polarity, voltage change on the data line is reduced and the energy loss on the data line is reduced accordingly.

Preferably, as indicated in FIG. 3, the pixel electrodes PEL(1,1) and PEL(1,2) of the left sub-pixels PL(1,1) and PL(1,2) substantially have the same area, and the pixel electrodes PER(1,1) and PER(1,2) of the right sub-pixels PR(1,1) and PR(1,2) substantially also have the same area. Similarly, the pixel electrodes PEL(2,1) and PEL(2,2) of the left sub-pixel PL(2,1) and PL(2,2) substantially have the same area, and the pixel electrodes PER(1,2) and PER(2,2) of the right sub-pixels PR(1,2) and PR(2,2) substantially also have the same area.

For example, each of the first gray voltage generating unit 202(1), the second gray voltage generating unit 202(2), the third gray voltage generating unit 202(3) and the fourth gray voltage generating unit 202(4) is embodied by a resistor string. Alternatively, the first gray voltage generating unit 202(1) and the fourth gray voltage generating unit 202(4) are embodied by a resistor string, and the second gray voltage generating unit 202(2) and the third gray voltage generating unit 202(3) are embodied by another resistor string.

Figure 6:
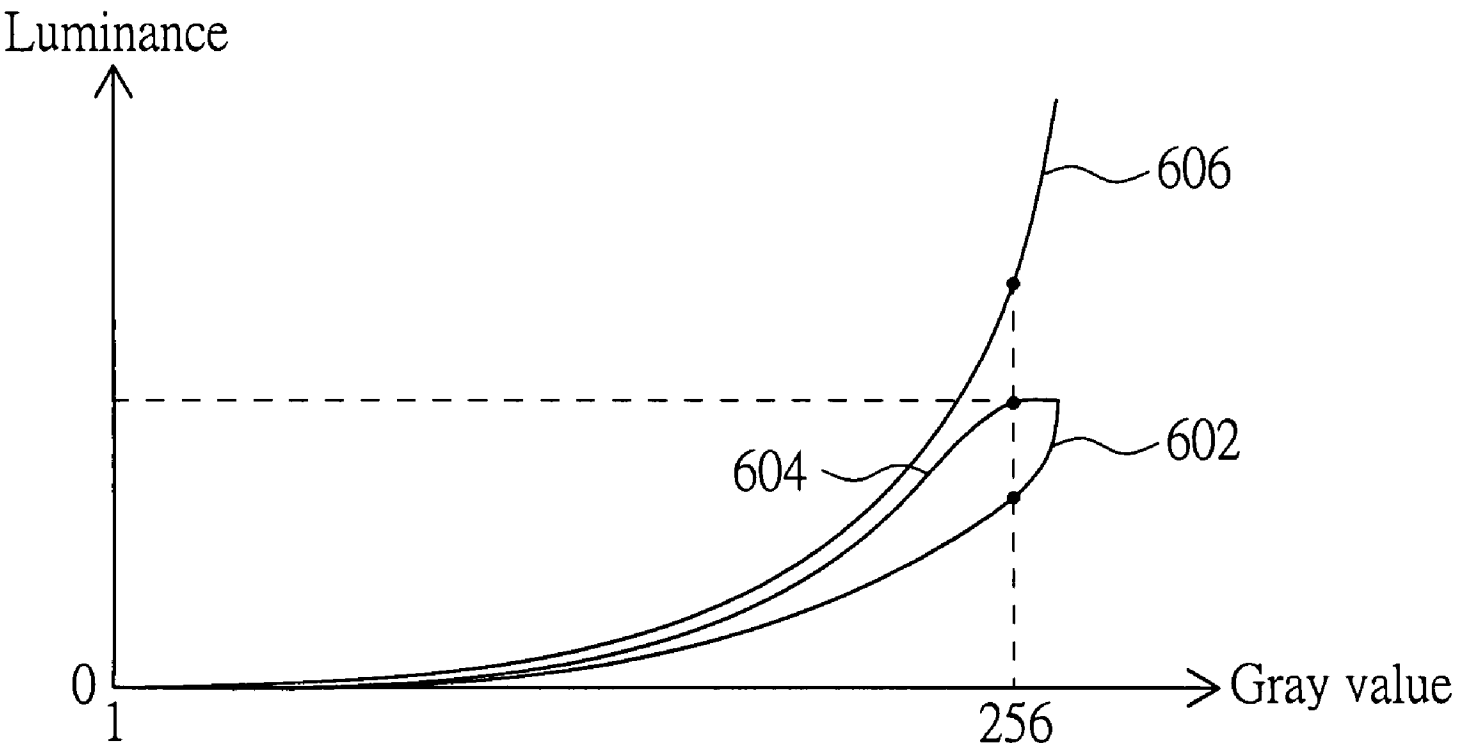
FIG. 6 shows a relationship curve of gray value vs. luminance of the left sub-pixel PL(1,1), the right sub-pixel PR(1, 1) and the pixel P(1,1) according to an embodiment of the invention.

Referring to FIG. 6, a relationship curve of gray value vs. luminance of the left sub-pixel PL(1,1), the right sub-pixel PR(1,1) and the pixel P(1,1) according to an embodiment of the invention is shown. The relationship curve 602 shows an example of gray value vs. luminance relationship of the left sub-pixel PL(1,1). The relationship curve 604 shows an example of gray value vs. luminance relationship of the right sub-pixel PR(1,1). The relationship curve 606 shows an example of gray value vs. luminance relationship of the pixel P(1,1). The luminance of the pixel P(1,1) is the sum of the luminance of the left sub-pixel PL(1,1) and the right sub-pixel PR(1,1).

All the pixel voltages used for driving the left sub-pixel PL(1,1) are generated with reference to the first set of positive gray voltage G1P and the first set of negative gray voltage G1N, and all the pixel voltages used for driving the right sub-pixel PR(1,1) are generated with reference to the second set of positive gray voltage G2P and the second set of negative gray voltage G2N. Thus, when the pixel data has the same gray value, the pixel voltage transmitted to the left sub-pixel PL(1,1) will be different from that transmitted to the right sub-pixel PR(1,1). That is, the arrangement of the liquid crystal molecules of the left sub-pixel PL(1,1) will also be different from that of the right sub-pixel PR(1,1). Consequently, the view angle of the pixel P(1,1) is increased.

According to the present embodiment of the invention, two sets of positive gray voltage and two sets of negative gray voltage are provided, so that all the pixel voltages of the left sub-pixel PL are generated with reference to the first set of positive gray voltage G1P and the first set of negative gray voltage G1N and all the pixel voltages of the right sub-pixel PR are generated with reference to the second set of positive gray voltage G2P and the second set of negative gray voltage G2N. Thus, the timing controller 104 only needs to provide the same pixel data to the left sub-pixel PL and the right sub-pixel PR. According to the conventional method, different pixel data are provided to the left sub-pixel PL and the right sub-pixel PR. Thus, the frequency of the clock signal of the timing controller 104 and that of the data driver 106 of the present embodiment of the invention do not need to be doubled. Thus, the present embodiment of the invention reduces manufacturing cost without increasing the complexity of the circuit design of the timing controller and the data driver.

Second Embodiment

Figure 7:
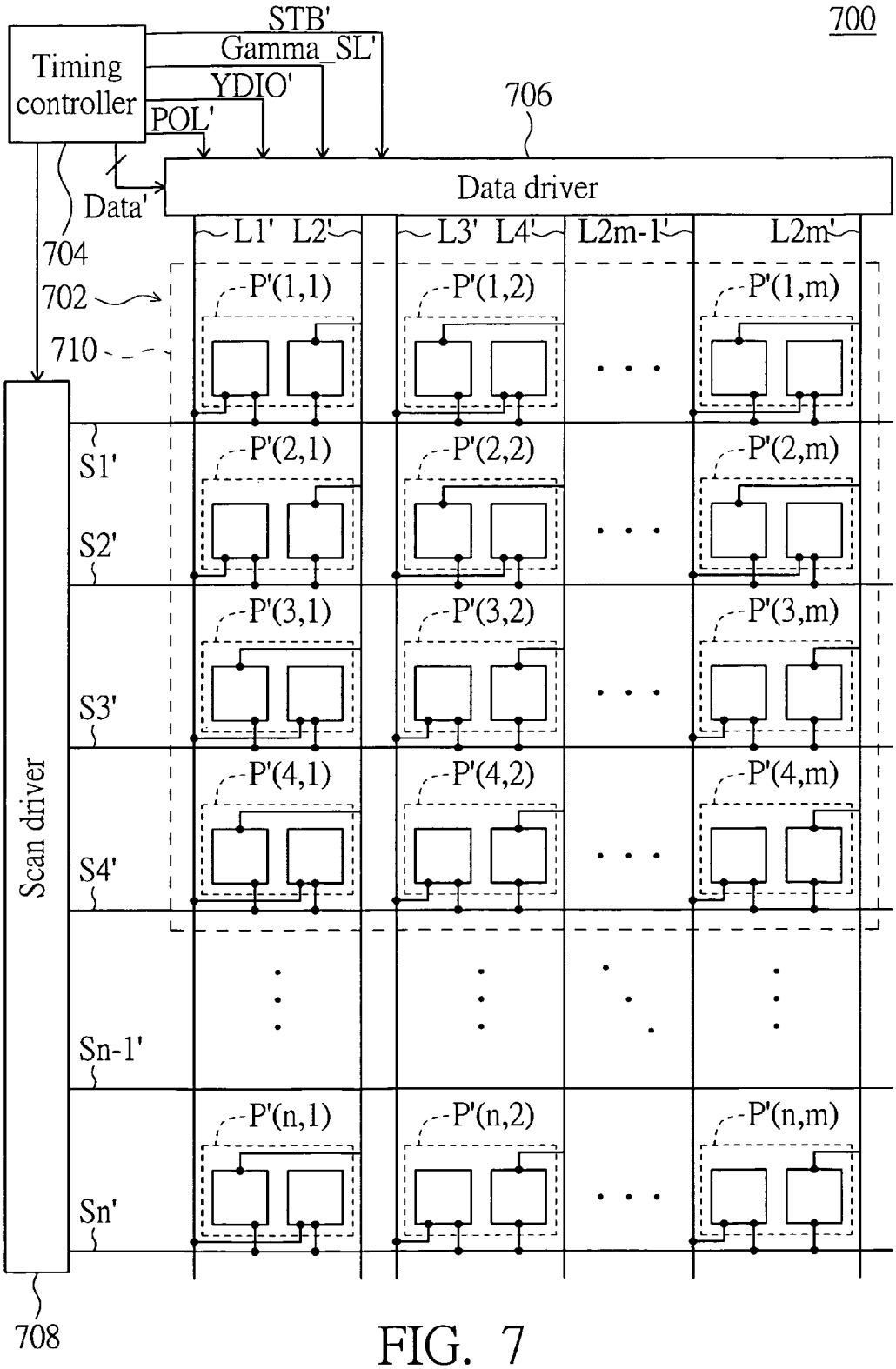
FIG. 7 shows a flat panel display using 2-line inversion driving method according to a second embodiment of the invention.

Referring to FIG. 7, a flat panel display 700 using 2-line inversion driving method according to a second embodiment of the invention. The flat panel display 700 includes a flat panel 702, a timing controller 704, a data driver 706 and a scan driver 708. The flat panel 702 includes a pixel array 710 including n rows and m columns of pixels P, a number of scan lines S1'~Sn' and a number of data lines L1'~L2*m*'.

The difference between the present embodiment and the first embodiment is as follows. In the pixel array 710, the connection between the sub-pixel and the data line is the same for each sub-pixel in two neighboring rows, and the gamma selecting signal Gamma_SL' does not change its state until two line periods have passed, so as to achieve 2-line inversion driving.

Let the pixels P'(1,1), P'(1,2), P'(2,1), P'(2,2), P'(3,1), P'(3,2), P'(4,1) and P'(4,2) disposed in the pixel array 710 be taken for example. Each pixel includes a left sub-pixel and a right sub-pixel. The data line L1 is electrically connected to the left sub-pixel PL'(1,1), the left sub-pixel PL(2,1), the right sub-pixel PR'(3,1) and the right sub-pixel PR'(4,1). The data line L2 is electrically connected to the right sub-pixel PR'(1,1), the right sub-pixel PR'(2,1), the left sub-pixel PL'(3,1) and left sub-pixel PL'(4,1). The data line L3 is electrically connected to the right sub-pixel PR'(1,2), the right sub-pixel PR'(2,2), the left sub-pixel PL'(3,2) and the left sub-pixel PL'(4,2). The data line L4 is electrically connected to the left sub-pixel PL'(1,2), the left sub-pixel PL'(2,2), the right sub-pixel PR'(3,2) and the right sub-pixel PR'(4,2).

The scan lines S1 to S4 are lined up in order. The scan line S1 is for controlling the pixels P'(1,1) and P'(1,2). The scan line S2 is for controlling the pixels P'(2,1) and P'(2,2). The scan line S3 is for controlling the pixels P'(3,1) and P'(3,2). The scan line S4 is for controlling the pixels P'(4,1) and P'(4,2).

Figure 9:
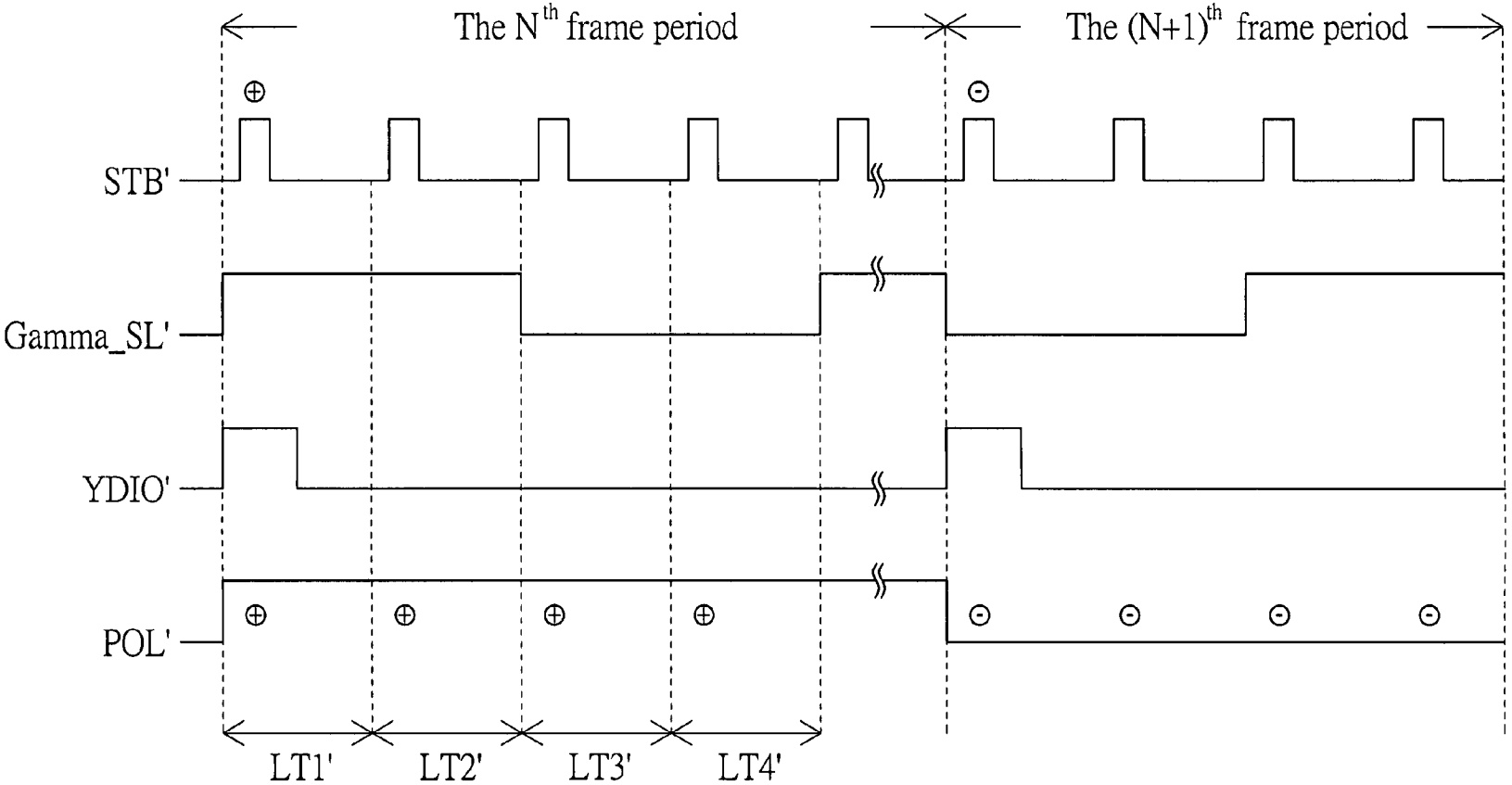
FIG. 9 shows an example of a charge/discharge starting signal STB', a gamma selecting signal Gamma_SL', a frame starting signal YDIO' and a polarity inversion signal POL' according to an embodiment of the invention.
Figure 10A:
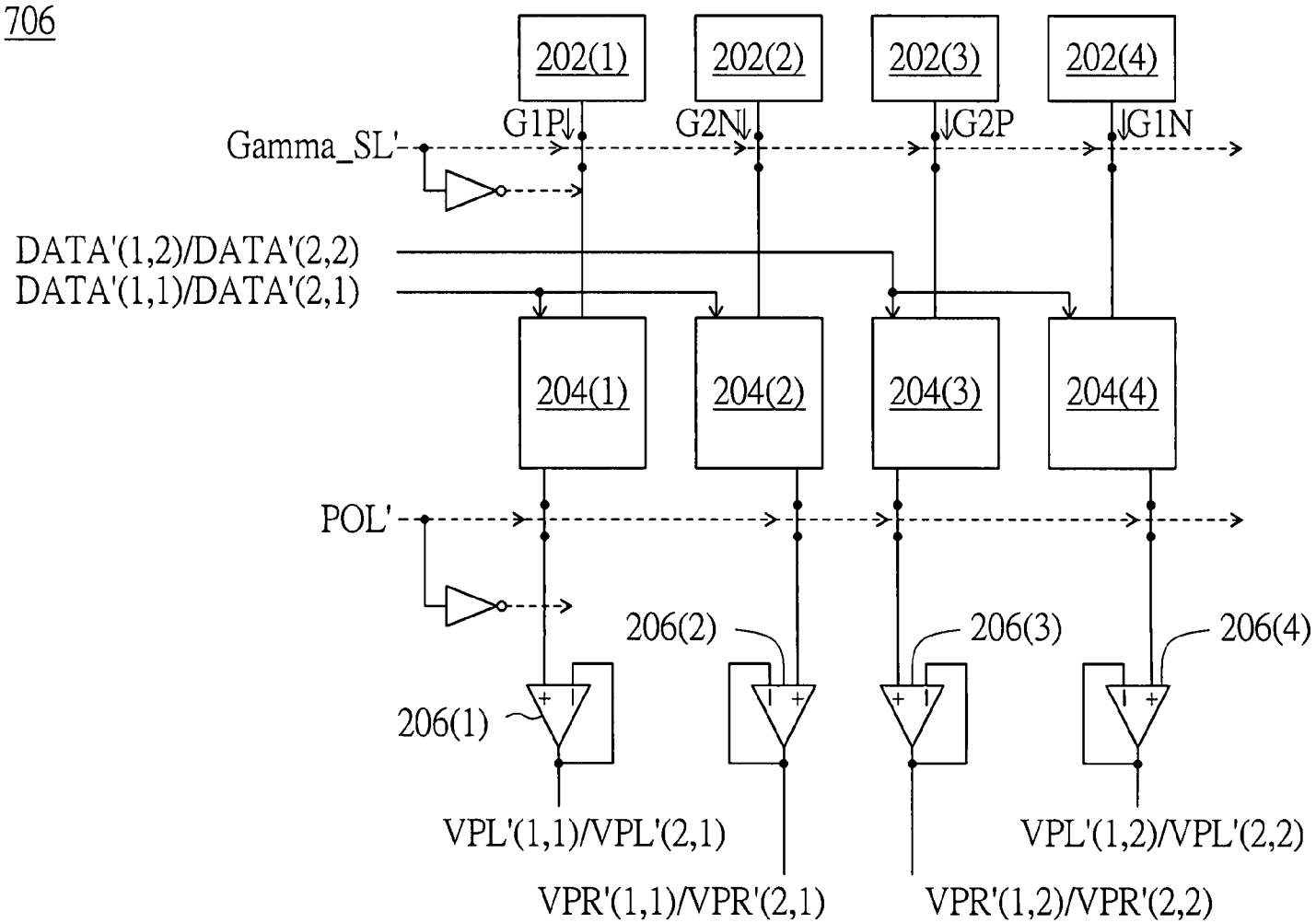
FIG. 10A shows an equivalent circuit diagram of the data driver of FIG. 7 within a first line period LT1' and a second line period LT2' of an $N^{th}$ frame period of FIG. 9.
Figure 10B:
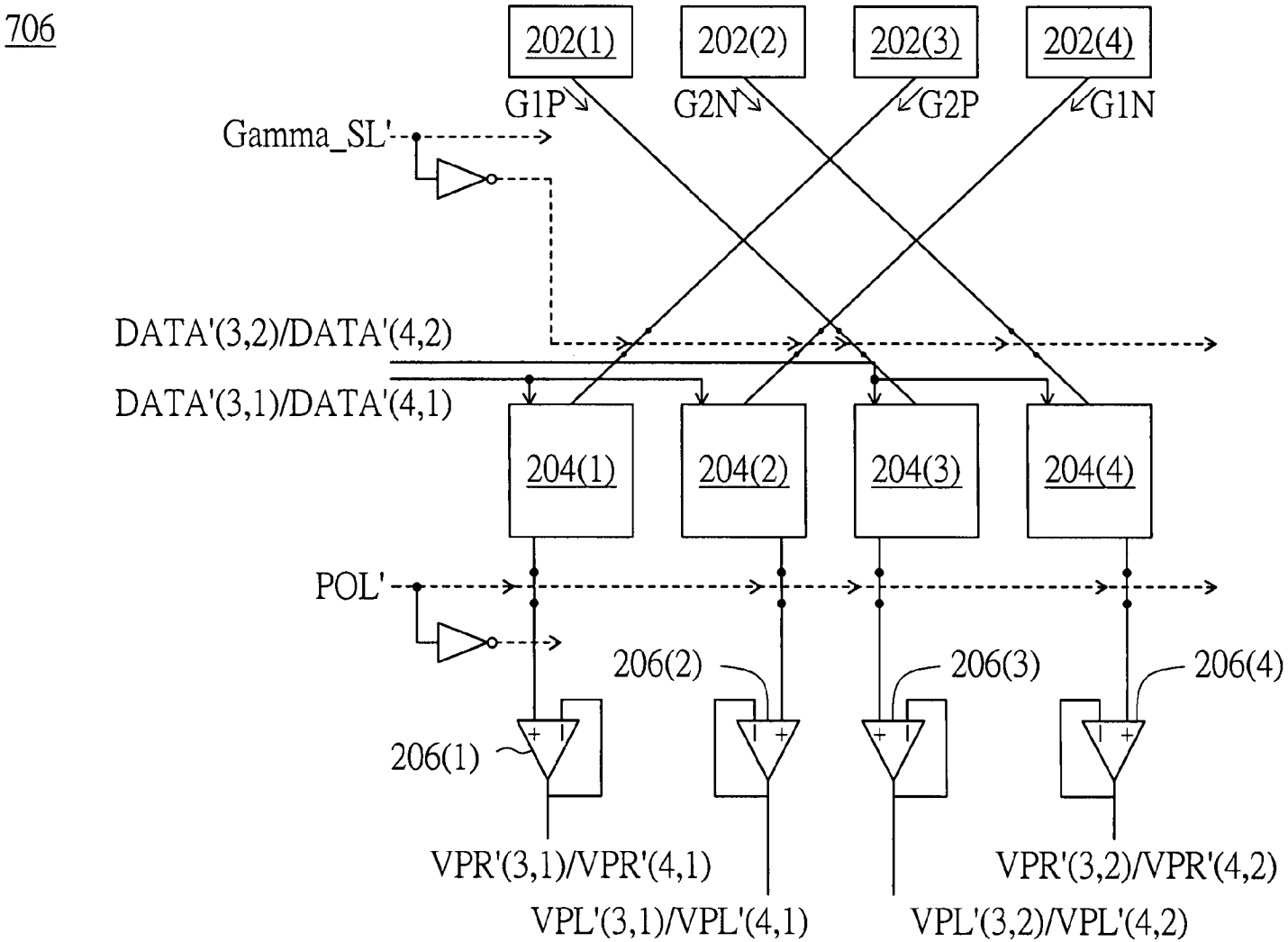
FIG. 10B shows an equivalent circuit diagram of the data driver of FIG. 7 within a third line period LT3' and a fourth line period LT4' of the Nth frame period of FIG. 9.

The operation of the present embodiment of the invention is disclosed below. Referring to FIG. 8, FIG. 9, FIG. 10A and FIG. 10B, FIG. 8 shows an example of the pixel array 710 of FIG. 7; FIG. 9 shows an example of a charge/discharge starting signal STB', a gamma selecting signal Gamma_SL', a frame starting signal YDIO' and a polarity inversion signal POL' according to the present embodiment of the invention; FIG. 10A shows an equivalent circuit diagram of the data driver 706 of FIG. 7 within a first line period LT1' and a second line period LT2' of an $N^{th}$ frame period of FIG. 9; and FIG. 10B shows an equivalent circuit diagram of the data driver 706 of FIG. 7 within a third line period LT3' and a fourth line period LT4' of the $N^{th}$ frame period of FIG. 9.

As indicated in FIG. 10A, within the first line period LT1' and the second line period LT2', the pixels disposed in the first row and the second row of the pixel array 710 are respectively driven by the data driver 706. Within the first line period LT1', the timing controller 706 outputs the pixel data DATA'(1,1) corresponding to the pixel P'(1,1) to the first and the second digital-to-analog converters 204(1) and 204(2) and outputs the pixel data DATA'(1,2) corresponding to the pixel P'(1,2) to the third and the fourth digital-to-analog converters 204(3) and 204(4). Within the second line period LT2', the timing controller 706 outputs the pixel data DATA'(2,1) corresponding to the pixel P'(2,1) to the first and the second digital-to-analog converters 204(1) and 204(2), and outputs the pixel data DATA'(2,2) corresponding to the pixel P'(2,2) to the third and the fourth digital-to-analog converters 204(3) and 204(4).

Within the first line period LT1, the gamma selecting signal Gamma_SL is in a first state such as at a high level and the polarity inversion signal POL is in a third state such as at a high level. Thus, within the first line period LT1', the positive polarity pixel voltage VPL'(1,1), the negative polarity pixel voltage VPR'(1,1), the positive polarity pixel voltage VPR'(1,2) and the negative polarity pixel voltage VPL'(1,2) outputted by the buffers 206(1)~206(4) of the data driver 706 are transmitted to the left sub-pixel PL'(1,1), the right sub-pixel PR'(1,1), the right sub-pixel PR'(1,2) and left sub-pixel PL'(1,2), respectively.

Similarly, within the second line period LT2', the gamma selecting signal Gamma_SL also remains in the first state and the polarity inversion signal POL still remains in the third state. Thus, within the second line period LT2', the positive polarity pixel voltage VPL'(2,1), the negative polarity pixel voltage VPR'(2,1), the positive polarity pixel voltage VPR'(2,2) and the negative polarity pixel voltage VPL'(2,2) outputted by the buffers 206(1)~206(4) of the data driver 706 are transmitted to the left sub-pixel PL'(2,1), the right sub-pixel PR'(2,1), the right sub-pixel PR'(2,2) and left sub-pixel PL'(2,2), respectively.

As indicated in FIG. 10B, within the third line period LT3' and the fourth line period LT4', the pixels disposed in the third row pixel and the fourth row of the pixel array 710 are respectively driven by the data driver 706. Within the third line period LT3', the timing controller 706 outputs the pixel data DATA'(3,1) corresponding to the pixel P'(3,1) to the first and the second digital-to-analog converters 204(1) and 204(2), and outputs the pixel data DATA'(3,2) corresponding to the pixel P'(3,2) to the third and the fourth digital-to-analog converters 204(3) and 204(4). Within the fourth line period LT4', the timing controller 706 outputs the pixel data DATA'(4,1) corresponding to the pixel P'(4,1) to the first and the second digital-to-analog converters 204(1) and 204(2), and outputs the pixel data DATA'(4,2) corresponding to the pixel P'(4,2) to the third and the fourth digital-to-analog converters 204(3) and 204(4).

Meanwhile, the gamma selecting signal Gamma_SL is converted to the second state such as at a low level but the polarity inversion signal POL is still in the third state (high level). Thus, the positive polarity pixel voltage VPR'(3,1), the negative polarity pixel voltage VPL'(3,1), the positive polarity pixel voltage VPL'(3,2) and the negative polarity pixel voltage VPR'(3,2) outputted by the first to the fourth buffers 206(1)~206(4) are transmitted to the right sub-pixel PR'(3,1), the left sub-pixel PL'(3,1), the left sub-pixel PL'(3,2) and the right sub-pixel PR'(3,2), respectively.

Similarly, within the fourth line period LT4', the gamma selecting signal Gamma_SL also remains in the second state and the polarity inversion signal POL still remains in the third state. Thus, within the fourth line period LT4', the positive polarity pixel voltage VPR'(4,1), the negative polarity pixel voltage VPL'(4,1), the positive polarity pixel voltage VPL'(4,2) and the negative polarity pixel voltage VPR'(4,2) outputted by the first to the fourth buffers 206(1)~206(4), are transmitted to the right sub-pixel PR'(4,1), the left sub-pixel PL'(4,1), the left sub-pixel PL'(4,2) and the right sub-pixel PR'(4,2), respectively.

Figure 8:
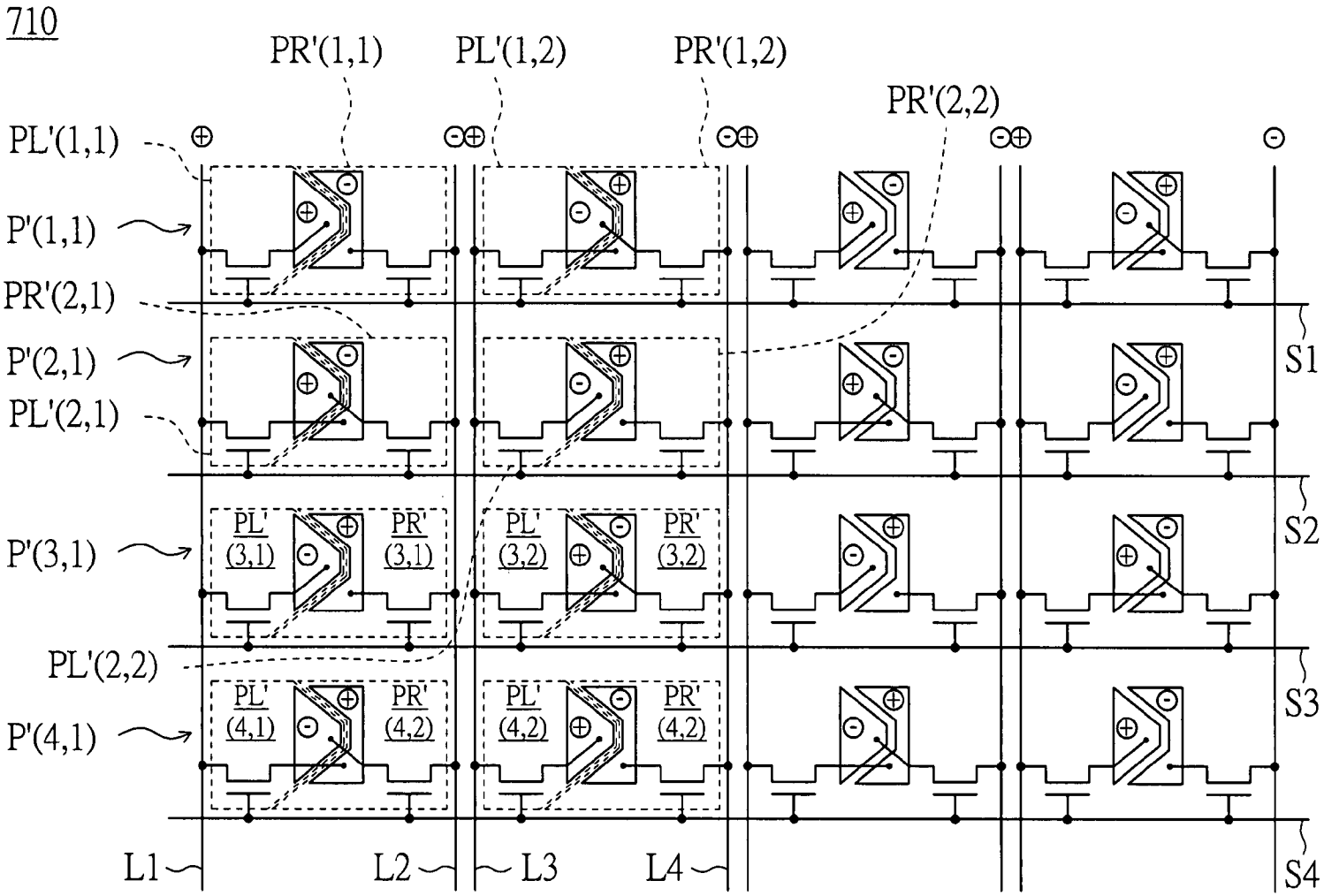
FIG. 8 is an example of the pixel array of FIG. 7.

The polarities of these sub-pixels are shown in FIG. 8. As indicated in FIG. 8, adjacent sub-pixels disposed in the first row and the second row have the same polarity, and adjacent sub-pixels disposed in the third row and the fourth row have the same polarity, but the polarity of adjacent sub-pixels disposed in the third row and the fourth row is different from that of the sub-pixel in the second row. Thus, driving method according the waveform in FIG. 9 achieves 2-line inversion driving.

The present embodiment of the invention also has the advantages of increasing view angle and reducing energy loss by reducing voltage change on the data line without increasing the frequency of the clock signal of the timing controller 704 and the data driver 706.

The invention is applicable to the flat panel display with various inversion driving methods by having a data driver using a gamma selecting signal. The data driver of the invention is applicable to the dot inversion driving method (as in the first embodiment) and the 2-line inversion driving method (as in the second embodiment), but the application of the invention is not limited to the above two driving methods. Different inversion driving effect can be achieved by changing the waveform of the gamma selecting signal and polarity inversion signal for allowing the left sub-pixel and the right sub-pixel to receive a pixel voltage with positive polarity or negative polarity. Thus, the data driver of the invention possesses excellent flexibility.

While the invention has been described by way of example and in terms of a preferred embodiment, it is to be understood that the invention is not limited thereto. On the contrary, it is intended to cover various modifications and similar arrangements and procedures and the scope of the appended claims therefore should be accorded the broadest interpretation so as to encompass all such modifications and similar arrangements and procedures.

What is claimed is:

1. A data driver, for driving a flat panel comprising a first pixel, a second pixel and a first to a fourth data lines, wherein the first to the fourth data lines are electrically connected to a first left sub-pixel, a first right sub-pixel comprised in the first pixel, and a second right sub-pixel and a second left sub-pixel comprised in the second pixel, respectively, the data driver comprising:

a first to a fourth gray voltage generating units for outputting a first set of positive gray voltage, a second set of negative gray voltage, a second set of positive gray voltage and a first set of negative gray voltage, respectively , wherein the first set of positive and negative gray voltages are corresponding to the first and the second left sub-pixels, respectively, and the second set of positive and negative gray voltages are corresponding to the first and the second right sub-pixels, respectively;

a first to a fourth digital-to-analog converters, wherein when a gamma selecting signal is in a first state, the input ends of the first to the fourth digital-to-analog converters are electrically connected to the output ends of the first to the fourth gray voltage generating units respectively, and when the gamma selecting signal is in a second state, the input ends of the first to the fourth digital-to-analog converters are electrically connected to the output ends of the third, the fourth, the first and the second gray voltage generating units, respectively; and a first to a fourth buffers, the output ends of the first to the fourth buffers are electrically connected to the first to a fourth data lines, respectively, wherein the input ends of the first to the fourth buffers are electrically connected to the output ends of the first to the fourth digital-to-analog converters respectively when a polarity inversion signal is in a third state, and to that of the second, the first, the fourth and the third digital-to-analog converters, respectively when the polarity inversion signal is in a fourth state.

2. A flat panel display, comprising:

a flat panel, comprising:

a first pixel and a second pixel, wherein the first pixel comprises a first left sub-pixel and a first right sub-pixel, and the second pixel comprises a second left sub-pixel and a second right sub-pixel;

a first scan line for controlling the first and the second pixels; and a first to a fourth data lines electrically connected to the first left sub-pixel, the first right sub-pixel, the second right sub-pixel and the second left sub-pixel, respectively;

a timing controller for outputting a polarity inversion signal and a gamma selecting signal; and a data driver, comprising:

a first to a fourth gray voltage generating units for driving the sub pixels and outputting a first set of positive gray voltage, a second set of negative gray voltage, a second set of positive gray voltage and a first set of negative gray voltage, respectively; and a first to a fourth digital-to-analog converters, wherein when the gamma selecting signal is in a first state, the input ends of the first to the fourth digital-to-analog converters are electrically connected to the output ends of the first to the fourth gray voltage generating units respectively, and when the gamma selecting signal is in a second state, the input ends of the first to the fourth digital-to-analog converters are electrically connected to the output ends of the third, the fourth, the first and the second gray voltage generating units, respectively.

3. The flat panel display according to claim 2, wherein the data driver further comprises a first to a fourth buffers, when the polarity inversion signal is in a third state, the input ends of the first to the fourth buffers are electrically connected to the output ends of the first to the fourth digital-to-analog converters respectively, and when the polarity inversion signal is in a fourth state, the input ends of the first to the fourth buffers are electrically connected to the output ends of the second, the first, the fourth and the third digital-to-analog converters respectively, and the output ends of the first to the fourth buffers are electrically connected to the first to the fourth data lines, respectively.

4. The flat panel display according to claim 3, wherein when the first pixel and the second pixel are driven in a first frame time, the polarity inversion signal is in one of the third state and the fourth state, and when the first pixel and the second pixel are driven in a second frame time, the polarity inversion signal is in the other of the third state and the fourth state, the first frame time and the second frame time are adjacent to each other.

5. The flat panel display according to claim 2, wherein the timing controller is for outputting a first pixel data corresponding to the first pixel to the first and the second digital-to-analog converters, and outputting the second pixel data corresponding to the second pixel to the third and the fourth digital-to-analog converter, the first set of positive gray voltage and the first set of negative gray voltage correspond to the first left sub-pixel and the second left sub-pixel, and the second set of positive gray voltage and the second set of negative gray voltage correspond to the first right sub-pixel and the second right sub-pixel.

6. The flat panel display according to claim 5, wherein the pixel electrodes of the first left sub-pixel and the second left sub-pixel substantially have the same area, and the pixel electrodes of the first right sub-pixel and the second right sub-pixel also substantially have the same area.

7. The flat panel display according to claim 5, wherein the panel further comprises:

a third pixel and an eighth pixel, each comprising a left sub-pixel and a right sub-pixel, wherein the first data line is electrically connected to the left sub-pixel of the third pixel, the right sub-pixel of the fifth pixel and the right sub-pixel of the seventh pixel, the second data line is electrically connected to the right sub-pixel of the third pixel, the left sub-pixel of the fifth pixel and the left sub-pixel of the seventh pixel, the third data line is electrically connected to the right sub-pixel of the fourth pixel, the left sub-pixel of the sixth pixel and the left sub-pixel of the eighth pixel, and the fourth data line is electrically connected to the left sub-pixel of the fourth pixel, the right sub-pixel of the sixth pixel and the right sub-pixel of the eighth pixel; and a second to a fourth scan lines, wherein the first to the fourth scan lines are lined up in order, the second scan line is for controlling the third pixel and the fourth pixel, the third scan line is for controlling the fifth pixel and the sixth pixel, and the fourth scan line is for controlling the seventh pixel and the eighth pixel;

wherein the timing controller is for outputting a third pixel data corresponding to the third pixel, a fifth pixel data corresponding to the fifth pixel and a seventh pixel data corresponding to the seventh pixel to the first and the second digital-to-analog converters, and outputting a fourth pixel data corresponding to the fourth pixel, a sixth pixel data corresponding to the sixth pixel and an eighth pixel data corresponding to the eighth pixel to the third and the fourth digital-to-analog converters;

wherein when the first to the fourth pixels are driven, the gamma selecting signal in one of the first state and the second state, and when the fifth to the eighth pixels are driven, the gamma selecting signal is in the other of the first state and the second state.

8. The flat panel display according to claim 5, wherein the panel further comprises:

a third pixel and a fourth pixel, wherein the third pixel comprises a third left sub-pixel and a third right sub-pixel, the fourth pixel comprises a fourth left sub-pixel and a fourth right sub-pixel, and the first to the fourth data lines are electrically connected to the third right sub-pixel, the third left sub-pixel, the fourth left sub-pixel and the fourth right sub-pixel, respectively;

a second scan line adjacent to the first scan line for controlling the third pixel and the fourth pixel, wherein the timing controller is further for outputting a third pixel data corresponding to the third pixel to the first and the second digital-to-analog converters, and outputting a fourth pixel data corresponding to the fourth pixel to the third and the fourth digital-to-analog converters;

wherein when the first pixel and the second pixel are driven, the gamma selecting signal is in one of the first state and the second state, and when the third pixel and the fourth pixel are driven, the gamma selecting signal is in the other of the first state and the second state.

9. The flat panel display according to claim 8, wherein the pixel electrodes of the third left sub-pixel and the fourth left sub-pixel substantially have the same area, and the pixel electrodes of the third right sub-pixel and the fourth right sub-pixel substantially also have the same area.

10. A method of driving a flat panel, wherein the flat panel comprises a first pixel, a second pixel and a first to a fourth data lines, the first pixel comprises a first left sub-pixel and a first right sub-pixel, and the second pixel comprises a second left sub-pixel and a second right sub-pixel, the first to the fourth data lines are electrically connected to the first left sub-pixel, the first right sub-pixel, the second right sub-pixel and the second left sub-pixel, respectively, the driving method comprises:

receiving a first pixel data, a second pixel data, a polarity inversion signal and a gamma selecting signal;

generating a first set of positive gray voltage, a second set of negative gray voltage, a second set of positive gray voltage and a first set of negative gray voltage;

performing digital-to-analog conversion to the first pixel data, the first pixel data, the second pixel data and the second pixel data according to the first set of positive gray voltage, the second set of negative gray voltage, the second set of positive gray voltage and the first set of negative gray voltage by a first to a fourth digital-to-analog converters, respectively, when the gamma selecting signal is in a first state;

performing digital-to-analog conversion to the first pixel data, the first pixel data, the second pixel data and the second pixel data according to the second set of positive gray voltage, the first set of negative gray voltage, the first set of positive gray voltage and the second set of negative gray voltage by the first to the fourth digital-to-analog converters, respectively, when the gamma selecting signal is in a second state;

receiving the output signals of the first to the fourth digital-to-analog converters by a first to a fourth buffers, respectively, when the polarity inversion signal is in a third state;

receiving the output signals of the second, the first, the fourth and the third digital-to-analog converters by the first to the fourth buffers, respectively, when the polarity inversion signal is in a fourth state; and driving the first left sub-pixel, the first right sub-pixel, the second right sub-pixel and the second left sub-pixel via the first to the fourth data lines by the first to the fourth buffers, respectively.

11. The driving method according to claim 10, wherein the panel further comprises a third pixel and a fourth pixel and a second scan line, the third pixel comprises a third left sub-pixel and a third right sub-pixel, the fourth pixel comprises a fourth left sub-pixel and a fourth right sub-pixel, the first to the fourth data lines are electrically connected to the third right sub-pixel, the third left sub-pixel, the fourth left sub-pixel and the fourth right sub-pixel respectively, and the second scan line is adjacent to the first scan line for controlling the third pixel and the fourth pixel, the method further comprises:

receiving a third pixel data and a fourth pixel data;

performing digital-to-analog conversion to the third pixel data by the first and second digital-to-analog converters according to the first set of positive gray voltage, and the second set of negative gray voltage, respectively, and performing the same to the fourth pixel data by the third and fourth digital-to-analog converters according to the second set of positive gray voltage and the first set of negative gray voltage, respectively, when the gamma selecting signal is in the first state;

performing digital-to-analog conversion to the third pixel data by the first and second digital-to-analog converters according to the second set of positive gray voltage, and the first set of negative gray voltage, respectively, and performing the same to the fourth pixel data by the third and fourth digital-to-analog converters according to the first set of positive gray voltage and the second set of negative gray voltage, respectively, when the gamma selecting signal is in the second state;

driving the third right sub-pixel, the third left sub-pixel, the fourth left sub-pixel and the fourth right sub-pixel via the first to the fourth data lines by the first to the fourth buffers, respectively, wherein when the first pixel and the second pixel are driven, the gamma selecting signal is in one of the first state and the second state, and when the third pixel and the fourth pixel are driven, the gamma selecting signal is in the other of the first state and the second state.

12. The driving method according to claim 10, wherein the panel further comprises a third to an eighth pixels and a second to a fourth scan lines, each pixel comprises a left sub-pixel and a right sub-pixel, the first data line is electrically connected to the left sub-pixel of the third pixel, the right sub-pixel of the fifth pixel and the right sub-pixel of the seventh pixel, the second data line is electrically connected to the right sub-pixel of the third pixel, the left sub-pixel of the fifth pixel and the left sub-pixel of the seventh pixel, the third data line is electrically connected to the right sub-pixel of the fourth pixel, the left sub-pixel of the sixth pixel and the left sub-pixel of the eighth pixel, the fourth data line is electrically connected to the left sub-pixel of the fourth pixel, the right sub-pixel of the sixth pixel and the right sub-pixel of the eighth pixel, the first to the fourth scan line are lined up in order, the second scan line is for controlling the third pixel and the fourth pixel, the third scan line is for controlling the fifth pixel and the sixth pixel and the fourth scan line is for controlling the seventh pixel and the eighth pixel, wherein when the first to the fourth pixels are driven, the gamma selecting signal is in one of the first state and the second state, and when the fifth to the eighth pixels are driven, the gamma selecting signal is in the other of the first state and the second state.

13. The driving method according to claim 10, wherein when the first pixel and the second pixel are driven in a first frame time, the polarity inversion signal is in one of the third state and the fourth state, when the first pixel and the second pixel are driven in a second frame time, the polarity inversion signal is in the other of the third state and the fourth state, and the first frame time and the second frame time are adjacent to each other.

14. The driving method according to claim 10, wherein the first set of positive gray voltage and the first set of negative gray voltage correspond to the first left sub-pixel and the second left sub-pixel, and the second set of positive gray voltage and the second set of negative gray voltage correspond to the first right sub-pixel and the second right sub-pixel.

15. The driving method according to claim 14, wherein the pixel electrodes of the first left sub-pixel and the second left sub-pixel substantially have the same area, and the pixel electrodes of the first right sub-pixel and the second right sub-pixel substantially also have the same area.

16. The driving method according to claim 14, wherein the pixel electrode of the third left sub-pixel and the fourth left sub-pixel substantially have the same area, and the pixel electrodes of the third right sub-pixel and the fourth right sub-pixel substantially also have the same area.

* * * * *